US007908712B2

(12) United States Patent
Rudzewski et al.

(10) Patent No.: US 7,908,712 B2
(45) Date of Patent: Mar. 22, 2011

(54) HINGE FOR A VEHICLE DOOR

(75) Inventors: Stephen Rudzewski, Ingolstadt (DE); Dietmar Schreiber, München (DE); Mehrdad Haji Zadeh Armaki, Stuttgart (DE); Georg Dell, Remscheid (DE)

(73) Assignee: Edscha AG, Remscheid (DE)

( * ) Notice: Subject to any disclaimer, the term of this patent is extended or adjusted under 35 U.S.C. 154(b) by 363 days.

(21) Appl. No.: 11/665,441

(22) PCT Filed: Oct. 11, 2005

(86) PCT No.: PCT/DE2005/001814

§ 371 (c)(1),
(2), (4) Date: May 27, 2008

(87) PCT Pub. No.: WO2006/039905

PCT Pub. Date: Apr. 20, 2006

(65) Prior Publication Data

US 2009/0070964 A1 Mar. 19, 2009

(30) Foreign Application Priority Data

Oct. 12, 2004 (DE) ..... 10 2004 049 552

(51) Int. Cl.
*E05D 11/06* (2006.01)

(52) U.S. Cl. ..... 16/375; 16/334; 16/344

(58) Field of Classification Search ..... 16/374, 16/375, 332–335, 343, 344, 82; 296/146.12, 296/146.11, 146.1; 49/391, 394
See application file for complete search history.

(56) References Cited

U.S. PATENT DOCUMENTS

| | | | | | |
|---|---|---|---|---|---|
| 2,587,781 | A * | 3/1952 | Stanfield et al. | 49/391 |
| 3,178,762 | A | 4/1965 | Whiting | 16/375 |
| 3,869,158 | A * | 3/1975 | Ciciulla | 292/35 |
| 3,965,531 | A * | 6/1976 | Fox et al. | 16/338 |
| 4,569,733 | A | 2/1986 | Pinkhasov | 205/354 |
| 4,670,941 | A * | 6/1987 | Peterson | 16/332 |
| 5,218,738 | A * | 6/1993 | Krajenke | 16/334 |
| 5,570,498 | A * | 11/1996 | Hipkiss et al. | 16/258 |
| 6,073,308 | A * | 6/2000 | Linnenbrink et al. | 16/334 |
| 6,938,303 | B2 * | 9/2005 | Watson et al. | 16/334 |
| 2004/0020014 | A1 * | 2/2004 | Linnenbrink et al. | 16/344 |
| 2005/0184556 | A1 * | 8/2005 | Nania | 296/146.12 |

FOREIGN PATENT DOCUMENTS

| | | |
|---|---|---|
| DE | 19 87 601 | 6/1968 |
| DE | 43 22 567 | 7/1994 |

(Continued)

*Primary Examiner* — Chuck Y. Mah
(74) *Attorney, Agent, or Firm* — Davidson, Davidson & Kappel, LLC

(57) ABSTRACT

The invention relates to a hinge for a vehicle door, comprising a first hinge part that can be fixed to the door or the door frame, a second hinge part which is fixed to the other of the two components, i.e. the door frame or the door, and a hinge pin that defines a swiveling axis of the hinge and pivotally connects the first hinge part and the second hinge part to each other. The hinge pin is arranged nonrotably on the first hinge part or the second hinge part while being rotatably mounted in the other hinge part. The hinge further comprises an end stop which limits an opening movement of the first hinge part and the second hinge part. In order to create a hinge that allows the vehicle door to be opened securely, an adjusting mechanism which is assigned to the first hinge part or the second hinge part is provided for adjusting the end stop.

18 Claims, 3 Drawing Sheets

FOREIGN PATENT DOCUMENTS

| | | | | |
|---|---|---|---|---|
| DE | 19609331 | A1 | * | 9/1997 |
| DE | 196 51 400 | | | 6/1998 |
| DE | 299 18 559 | | | 1/2000 |
| DE | 202 19 786 | | | 3/2003 |
| EP | 208085 | A | * | 1/1987 |
| EP | 1306505 | A2 | * | 5/2003 |
| FR | 2 567 915 | | | 10/1987 |
| GB | 2 333 124 | | | 7/1999 |

* cited by examiner

HINGE FOR A VEHICLE DOOR

BACKGROND

The invention relates to a hinge for a vehicle door.

GB 2 333 124 A shows a hinge for a vehicle door, in which a first hinge part and a second hinge part are connected pivotably to each other by means of a hinge pin. A radially extending projection is arranged on the second hinge part and defines an end stop for the opening movement of the first and second hinge parts, the projection bearing against the second hinge part in the end stop. A disadvantage of this type of hinge is the fact that the opening angle of the hinge is predetermined by the end stop.

SUMMARY OF THE INVENTION

An object of the invention is to provide a hinge for a vehicle door, which permits secure opening of the vehicle door.

In accordance with an embodiment of the present invention, a hinge for a vehicle door comprises a first hinge part which can be fastened to either the door or door frame, a second hinge part which can be fastened to the other of the parts, the door or door frame, a hinge pin which defines a hinge pivot axis and connects the first hinge part and the second hinge part pivotably to each other, the hinge pin being arranged nonrotatably to one of the first hinge part and the second hinge part and being mounted rotatably in the other of the parts, the first hinge part or the second hinge part, and an end stop limiting an opening movement of the first hinge part and of the second hinge part. An adjusting arrangement is provided for adjusting the end stop. The adjusting arrangement is assigned to one of the first hinge part and the second hinge part.

The adjusting arrangement according to the invention for adjusting the end stop makes it possible for the end stop for limiting the opening movement of the two hinge parts to be adjustable, as a result of which different opening angles of the vehicle door are provided. It is thus possible for the hinge to be able to be matched to different vehicle doors which have different opening angles such that the hinge with an adjusting arrangement according to the invention for the end stop can be used in any type of vehicle door. The arrangement of the adjusting arrangement on one of the two hinge parts provides a compact constructional form of the hinge and reduces the construction space necessary for the adjusting arrangement. In addition, hinges which are already being used can therefore be retrofitted in a simple manner with the adjusting arrangement.

Furthermore, generally at least two hinges are arranged on a vehicle door, with the forces which occur in the end stop essentially being absorbed by one of the two hinges, and the end stop of the other of the two hinges merely being used as an emergency end stop, for example if the first hinge end stop should fail. In this case, the end stops of the two hinge parts are aligned with respect to each other in such a manner that the first hinge firstly strikes against its end stop, with the first hinge in the process absorbing all of the forces which occur and are produced by the striking of the vehicle door. The adjusting arrangement for adjusting the end stop makes it possible to adjust the end stop of the first hinge and the end stop of the second hinge with respect to each other such that, when the vehicle door strikes, the two hinges strike simultaneously against the end stop, and the forces which occur during the striking of the door are distributed to both hinge parts. The forces which occur during the striking of the door in the end stop are compensated for by a correspondingly solid configuration of the hinges. By distributing the forces to both hinges, a corresponding, weight-reduced configuration of the two hinges is provided.

An adjusting arrangement can be arranged on each of the two hinges, but is preferably only provided on one of the two hinges. In order to adjust the two end stops with respect to each other, the vehicle door is merely opened once as far as the end stop, with firstly the adjustable end stop of the one hinge being struck and the end stop of the other hinge not being used. However, owing to the adjusting arrangement, the end stop of the one hinge is provided in such a manner that it is also possible to pivot the door in a further opening movement, with a corresponding force being overcome. In order to adjust the two end stops, the door is opened further counter to this force until the door strikes against the end stop of the first hinge, with the end stop of the second hinge being adjusted at the same time by the adjusting arrangement and being matched to the end stop of the first hinge. The forces occurring during a striking of the door are therefore distributed to both hinges. The adjustment of the two end stops is possible during a first actuation of the door, but is also already possible during the installation of the vehicle door. The force distribution for the two hinges in the end stop can be configured in a variable manner, but with the retaining force of the adjusting arrangement being provided such that it is lower than the force which occurs in the end stop. A preferred distribution for absorbing the striking forces is provided by each of the two hinges approximately absorbing half of the forces. Any other distribution can also be provided, such as, for example, that the one hinge provided with the adjusting arrangement absorbs approximately 40% of the forces and the other hinge absorbs approximately 60%.

The adjusting arrangement advantageously has at least two positions for the end stop, as a result of which an adjustment of the end stop is designed in a variable manner. The effect achieved by this is that, after the first adjustment of the end stop, a further adjustment is possible, with a further adjustment being necessary, for example, by the vehicle door having a greater opening angle due to wear.

In a preferred refinement, the adjusting arrangement has an engagement element which engages in a toothing such that, by means of the adjusting arrangement, a plurality of positions of the end stop relative to the one hinge part are provided. It is thereby possible for the adjusting arrangement to be used in various hinges, with, due to different opening angles of the door, different adjusting possibilities for the end stop being required and advantageously being provided by the toothing of the adjusting arrangement.

The engagement element is expediently prestressed against the toothing by a spring element such that the engagement element can be securely fixed in the toothing, and the end stop is securely fixed. This avoids the end stop being displaced by external influences, for example by opening of the vehicle door, and therefore no longer being appropriately adjusted.

The toothing is advantageously provided in curved form, with the curvature expediently being designed as an arc of a circle, the center point of which is provided on the hinge axis. The effect achieved by this is that the adjustment of the end stop is in parallel with the pivoting movement of the hinge, and therefore the adjustment of the end stop takes place with the opening movement of the vehicle door in a common pivoting movement. By this means, extensive adjustment of the opening angle of the hinge is avoided.

Further advantages and features of the invention emerge from the description below and from the dependent claims.

BRIEF DESCRIPTION OF THE DRAWINGS

The invention will be explained in more detail herein below with reference to a preferred exemplary embodiment of a hinge according to the invention and with reference to the attached drawings.

DETAILED DESCRIPTION

Figure 1:
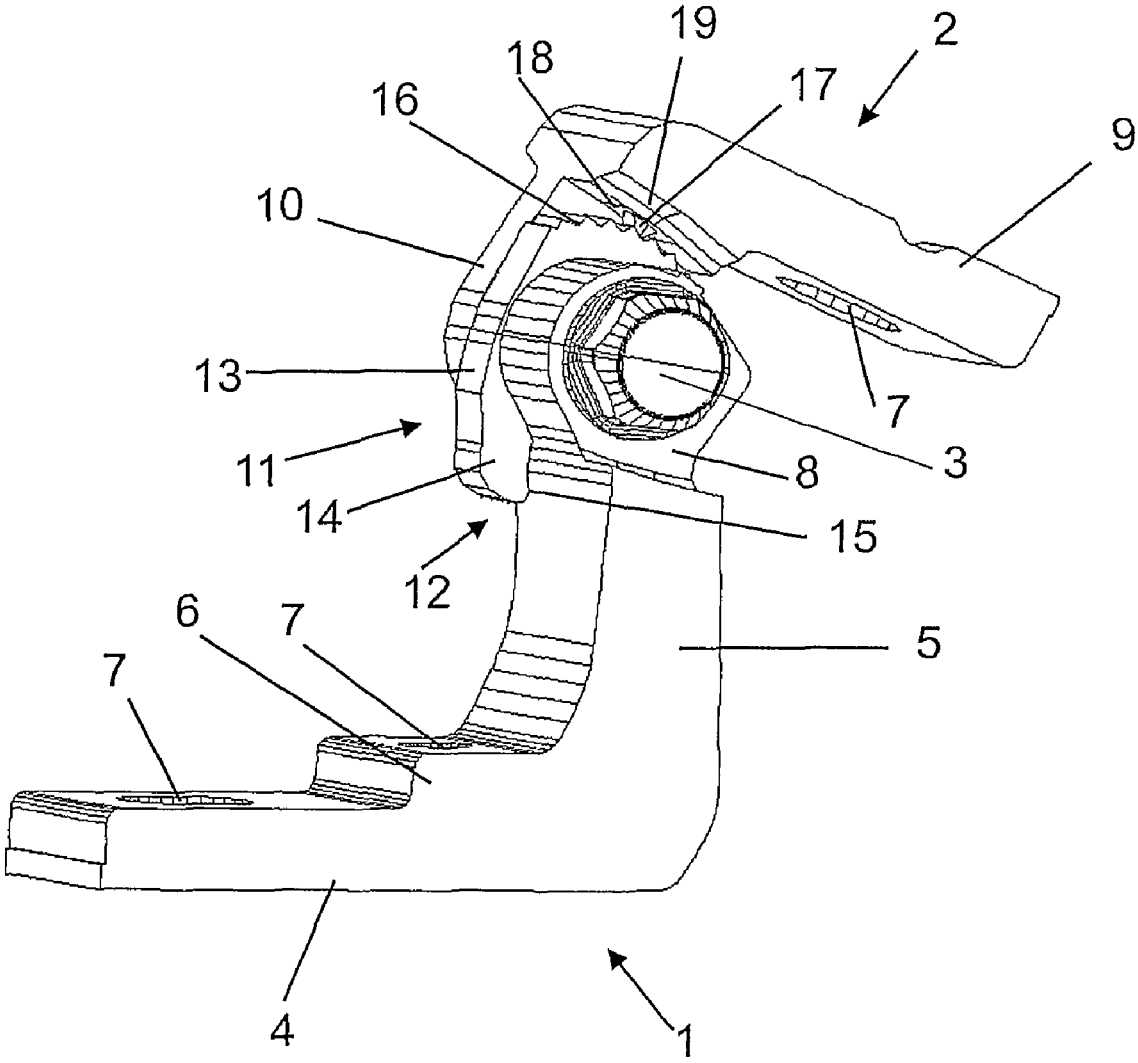
FIG. 1 shows a three-dimensional view of a preferred exemplary embodiment of a hinge according to the invention.
Figure 2:
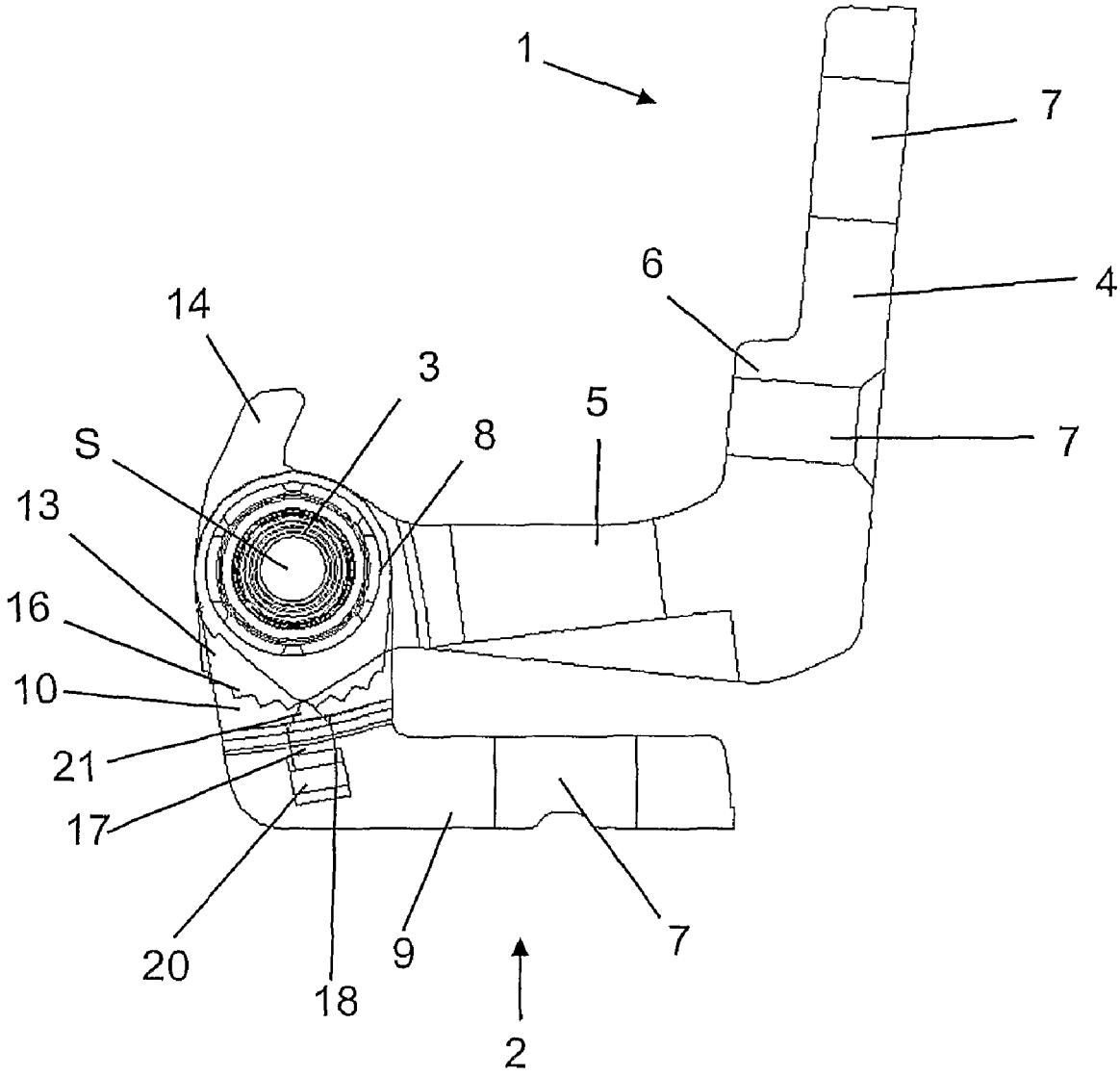
FIG. 2 shows a plan view of the preferred exemplary embodiment of a hinge according to the invention shown in FIG. 1 in a closed position.
Figure 3:
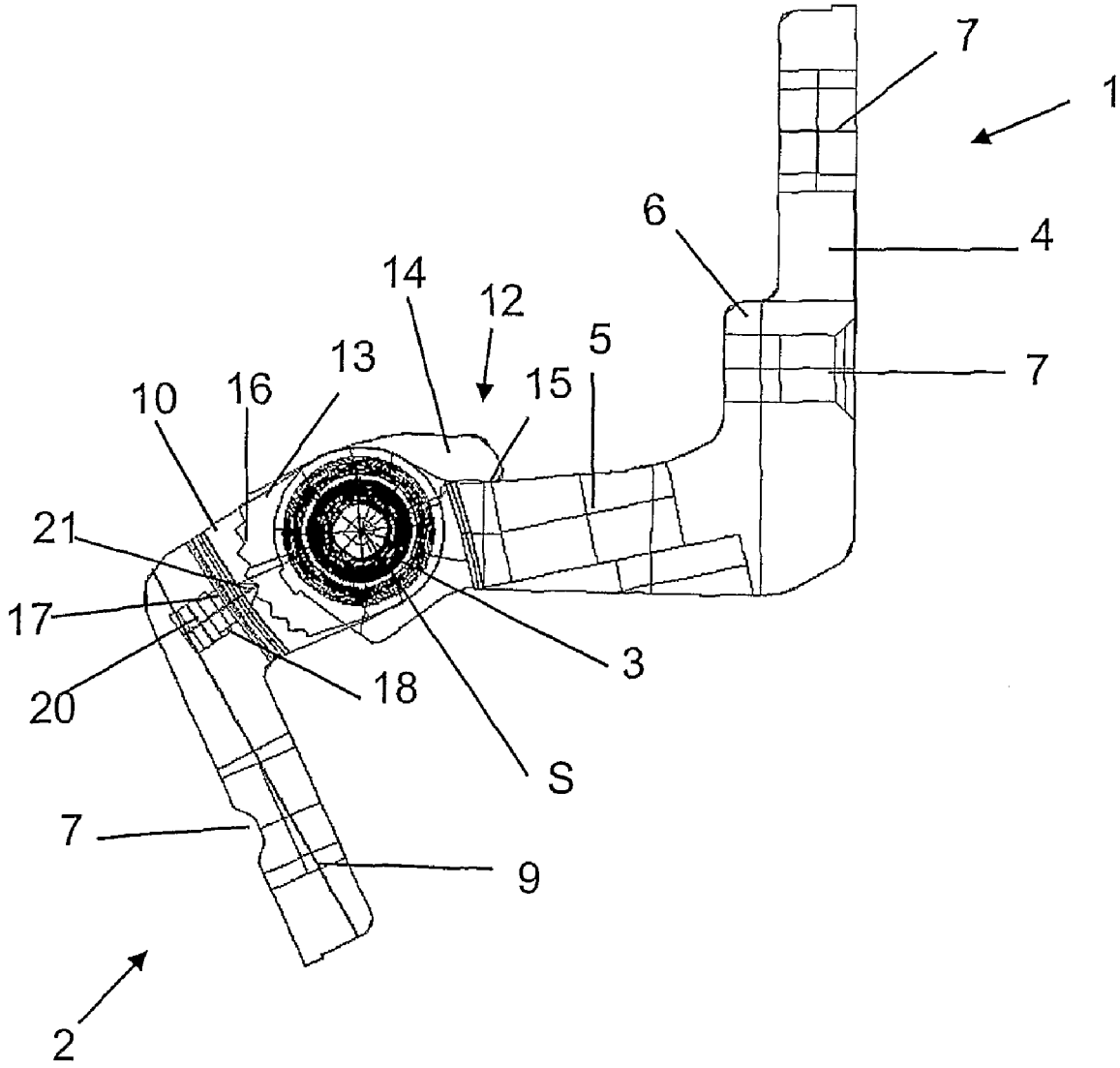
FIG. 3 shows a plan view of the preferred exemplary embodiment of a hinge according to the invention shown in FIG. 1 in an open position.

FIGS. 1, 2 and 3 show a preferred exemplary embodiment of a hinge according to the invention for a vehicle door, in which a first hinge part 1 and a second hinge part 2 are connected to each other pivotably about a hinge pivot axis S by means of a hinge pin 3.

The first hinge part 1 has an L-shaped configuration with a first limb 4 and a second limb 5, the first limb 4 and the second limb 5 being at an angle of approximately 90° with respect to each other. The first limb 4 has, approximately centrally, a thickened portion 6 which extends as far as the second limb 5, with a first fastening hole 7 being arranged in the thickened portion 6. A second fastening hole 7 is provided at that end of the first limb 4 which faces away from the second limb 5.

A hinge head 8 is provided at that end of the second limb 5 which faces away from the first limb 4, said hinge head having a hole in which the hinge pin 3 is arranged nonrotatably, the hinge pin 3 having, for example, a circumferential knurling in the region of the hole. Hinge pin 3 can also be arranged nonrotatably on the first hinge part 1 in any other manner, such as, for example, by means of a screw, rivet or clip connection.

The second hinge part 2 has an L-shaped form with a first limb 9 and a second limb 10, the first limb 9 and the second limb 10 being at an angle of approximately 90° with respect to each other. The second limb 10 is arranged approximately centrally with respect to the transverse extent of the first limb 9, the first limb 9 having a greater width than the second limb 10 and extending with a projection 19 in the transverse extent beyond the second limb 10.

A fastening hole 7 is provided in the first limb 9 of the second hinge part 2.

A gudgeon, in which the hinge pin 3 is mounted rotatably, is provided at that end of the second limb 10 of the second hinge part 2 which faces away from the first limb 9, with, for example, a bushing being provided on the hinge pin 3 in the region of the gudgeon.

An adjusting arrangement 11 for an end stop 12 is provided between the gudgeon 8 of the first hinge part 1 and the second limb 10 of the second hinge part 2. The adjusting arrangement 11 comprises a disk element 13 which is arranged pivotably on the hinge pin 3, with the disk element 13 likewise being provided rotatably in relation to the second hinge part 2. A radially extending projection 14 is provided on the disk element 13 and, together with a bearing surface 15 of the second limb 5 of the first hinge part 1, forms the end stop 12.

A toothing 16 is provided at that end of the disk element 13 which is opposite the projection 14, the toothing 16 being designed in curved form. The curvature of the toothing 16 defines an arc of a circle, the center point of which is provided on the hinge pivot axis S.

An engagement element 17 arranged on the first limb 9 of the second hinge part 2 engages in the toothing 16. The engagement element 17 is designed as a bolt which has a point 21 in its front end, which end enters into engagement with the toothing 16, the point 21 being matched to the intermediate spaces between the teeth of the toothing 16, in which intermediate spaces the point 21 engages.

The engagement element 17 is provided displaceably in a hole 18 arranged in the projection 19, which extends beyond the second limb 5 of the first hinge part 1. A spring element 20 is arranged in the hole 18 and prestresses the engagement element 17 against the toothing 16, with the spring element 20 being designed as a compression spring.

By engagement of the engagement element 17 in the toothing 16 arranged on the disk element 13, the disk element 13 is held releasably in relation to the second hinge part 2 counter to the force of the spring element 20 and fixes the projection 14, which forms the end stop 12, with respect to the second hinge part 2.

To adjust the end stop 12, with the projection 14 bearing against the bearing surface 15 of the first hinge part 1, the engagement element 17 is guided along the toothing 16 and, in the desired position of the end stop 12, engages in the toothing 16 and is held there on account of the spring force of the spring element 20.

The adjustment of the end stop of a vehicle door takes place as follows:

In order to adjust the end stop 12, the vehicle door is opened a first time, with the end stop 12 for the opening movement of the first hinge part 1 with respect to the second hinge part 2 of the one hinge firstly being provided by the projection 14 bearing against the bearing surface 15. In this case, the engagement element 17 is arranged in a position of the toothing 16, in which position the vehicle door has not yet quite reached the desired maximum opening angle and a greater pivoting movement is possible for the door.

In order now to adjust the end stop 12 as desired, it is possible to further pivot the second hinge part 2, which is connected to the vehicle door, in relation to the first hinge part 1 if the spring force of the spring element 20 is overcome in order to release the engagement element 17 from the toothing 16. If the desired opening angle for the end stop 12 of the vehicle door is now reached, the engagement element 17 latches again into the toothing 16 and is held there by the spring element 20. In this manner, for example, the end stops of two hinges arranged on a vehicle door can be matched to each other such that the two hinges have the same opening angle and therefore the same end stop.

The invention has been explained in more detail above with reference to an exemplary embodiment in which the two hinge parts are of l-shaped design. It goes without saying that the adjusting arrangement for the end stop can likewise be provided on differently configured hinge parts.

The invention has furthermore been explained in more detail above with reference to an exemplary embodiment, in which the adjusting arrangement has been explained in more detail by an engagement element held releasably in a toothing by means of a spring element. It goes without saying that the holding force necessary for the adjusting arrangement can also be provided by any other configuration, such as, for example, by a frictional connection or by a manual fixing means. The manual fixing means comprises, for example, a screw, for example a headless screw, which is arranged on the first hinge part and is secured in an opening arranged on the disk element in order to determine the end stop and therefore the opening angle of the hinge.

What is claimed is:

1. A hinge for a vehicle door comprising:

a first hinge part which can be fastened to one of a door and a door frame;

a second hinge part which can be fastened to the other of the door and the door frame, a hinge pin which defines a hinge pivot axis and connects the first hinge part and the second hinge part pivotably to each other;

an end stop for limiting an opening movement of the first hinge part and of the second hinge part;

an adjusting arrangement configured to allow displacement of the end stop with respect to the first hinge part and to the second hinge part to adjust a predetermined angular position delimiting the opening movement by adjusting a maximum opening angle of the door, the adjusting arrangement being arranged on the hinge pin between said first hinge part and said second hinge part, the adjusting arrangement including a disk element, the end stop including a projection arranged on the disk element; and wherein the adjusting arrangement can be adjusted by an opening movement of the first hinge part and the second hinge part around the hinge pivot axis.

2. The hinge as claimed in claim 1 wherein the adjusting arrangement allows at least two different positions for the end stop relative to one of the first hinge part and the second hinge part.

3. The hinge as claimed in claim 1 wherein the adjusting arrangement comprises at least one engagement element, and wherein the engagement element engages a toothing on the disk element.

4. The hinge as claimed in claim 3 wherein the engagement element is prestressed against the toothing by a spring element.

5. The hinge as claimed in claim 4 wherein the spring element is provided as a compression spring.

6. The hinge as claimed in claim 3 wherein the disk element is mounted on the hinge pin.

7. The hinge as claimed in claim 6 wherein the disk element is rotatably disposed around the hinge pivot axis.

8. The hinge as claimed in claim 3 wherein the toothing comprises a curvature.

9. The hinge as claimed in claim 8 wherein the curvature of the toothing defines an arc of a circle having a center point, and wherein the center point is defined by the hinge pivot axis.

10. The hinge as claimed in claim 1 wherein the adjusting arrangement further comprises a first contact surface of said one of the first hinge part and the second hinge part, the disk element including a second contact surface displaceable with respect to said one of the first hinge part and the second hinge part such that the first contact surface and the second contact surface are coupled by a force selected from the group comprising form-locking type force and friction-locking type force.

11. The hinge as claimed in claim 1 wherein the hinge pin is nonrotatably arranged in said one of the first hinge part and the second hinge part and wherein the hinge pin is rotatably arranged in the other of the first hinge part and the second hinge part.

12. A vehicle door hinge with an angular positioning arrangement, comprising:

a first hinge part for attachment to one of a vehicle door and a vehicle door frame, a second hinge part for attachment to the other of the vehicle door and the vehicle door frame, an intermediate hinge part being arranged between the first hinge part and the second hinge part in a hinge pivot axis direction;

wherein the intermediate hinge part comprises an end stop for abutting against the second hinge part and defining a maximum pivotal angle;

wherein the intermediate hinge part comprises a receiving surface into which a protruding element of the first hinge part engages; and wherein the protruding element and the receiving surface can be brought out of engagement until the maximum pivotal angle is achieved.

13. The vehicle door hinge as claimed in claim 12 wherein the receiving surface and the protruding element define a ratchet engagement.

14. The vehicle door hinge as claimed in claim 12 wherein a pivotal angle of the vehicle door hinge is adjustable to increase towards the maximum pivotal angle by displacing the end stop relative to the first hinge part.

15. The vehicle door hinge as claimed in claim 12 wherein the end stop is preadjusted to a pivotal angle between the end stop and the first hinge part, wherein the pivotal angle is smaller than the maximum pivotal angle before the hinge is attached to the door and the door frame.

16. A hinge with an adjustable maximum opening angle, comprising:

a first hinge part for attachment to one of a vehicle door and a vehicle door frame;

a second hinge part for attachment to the other of the vehicle door and the vehicle door frame;

the first hinge part and the second hinge part being pivotably connected;

an intermediate hinge part being in engagement with the first hinge part;

wherein the intermediate hinge part is displaceable with respect to the first hinge part by overcoming the engagement with the first hinge part; and wherein the intermediate hinge part comprises a projecting portion for abuttment against the second hinge part.

17. An attachment arrangement for a vehicle door, comprising:

the hinge as claimed in claim 16;

a second hinge;

the vehicle door being pivotably attachable to a vehicle door frame by means of the hinge and the second hinge;

wherein the hinge comprises a first end stop limiting an opening movement of the hinge;

wherein the second hinge comprises a second end stop limiting an opening movement of the second hinge;

wherein the intermediate hinge part of said hinge defines an adjusting arrangement for adjusting the first end stop such that the maximum opening angle of the hinge is adjusted; and wherein the adjusting arrangement can be adjusted by an opening movement of the vehicle door, such that the first end stop is brought in alignment with the second end stop.

18. An attachment arrangement for a vehicle door comprising a first hinge and a second hinge;

the vehicle door being pivotably attachable to a vehicle door frame by means of the first hinge and the second hinge;

wherein the first hinge comprises a first end stop limiting an opening movement of the first hinge;

wherein the second hinge comprises a second end stop limiting an opening movement of the second hinge;

wherein the first hinge comprises an adjusting arrangement for adjusting the first end stop by adjusting a maximum pivotal angle by displacing the first end stop with respect to a first hinge part of the first hinge and to a second hinge part of the first hinge, the adjusting arrangement being arranged between the first hinge part of the first hinge and the second hinge part of the first hinge; and wherein the adjusting arrangement can be adjusted by an opening movement of the vehicle door, such that the first end stop is brought in alignment with the second end stop.

* * * * *